United States Patent [19]

Olson

[11] Patent Number: 5,018,694

[45] Date of Patent: May 28, 1991

[54] CLOTHES HANGER SPACER

[75] Inventor: Heidi S. Olson, Barrington, Ill.

[73] Assignee: HICO Products, Inc., Barrington, Ill.

[21] Appl. No.: 554,084

[22] Filed: Jul. 17, 1990

Related U.S. Application Data

[63] Continuation-in-part of Ser. No. 451,045, Dec. 15, 1989, abandoned.

[51] Int. Cl.[5] ..... B42F 13/00

[52] U.S. Cl. ..... 248/340; 211/119

[58] Field of Search ..... 248/340, 303; 211/123, 211/119, 118; 24/230.5 W, 230.5 TP, 131 R; 223/85

[56] References Cited

U.S. PATENT DOCUMENTS

| | | | |
|---|---|---|---|
| 303,961 | 8/1884 | Wright | 24/230.5 TP |
| 622,341 | 4/1899 | Fleming | 24/230.5 TP |
| 2,183,188 | 12/1939 | French | 24/230.5 W |
| 3,104,434 | 9/1963 | Noordhoek | 24/230.5 W X |
| 3,902,227 | 9/1975 | Sherwood | 24/131 R |
| 4,308,962 | 1/1982 | Fahmi | 211/118 |
| 4,738,424 | 4/1988 | Conner | 248/340 |

*Primary Examiner*—J. Franklin Foss
*Attorney, Agent, or Firm*—Michael A. Slavin

[57] ABSTRACT

A clothes hanger spacer device for spacing garment hangers when suspended from a garment-supporting rod, comprising a one piece length of material having axially spaced apart hook-shaped opposite end portions for hooked over engagement with a garment-supporting rod, and a closed loop projecting beneath said axially spaced apart hook-shaped opposite end portions for dispostion beneath a garment-supporting rod for carrying a clothes hanger in hooked assembly with the closed loop. The device is disclosed in two forms with one form having hooked shaped opposite end portions being symmetrically shaped and oriented relative to one another and adapted to hook onto a garment-supporting rod. A modified form has hook shaped and opposite end portions being oriented so as to be attachable with a garment-supporting rod with tip ends located on opposite sides of the rod when in attachment. A third modified form has hook shaped and opposite end portions being oriented so as to be attachable with a garment-supporting rod with tip ends located on opposite sides of the rod when in attachment herewith, angular shaped sides further prevent the devices from overlapping one another when pressed into close service and an angular shaped bottom to assist in cloths hanger centering.

13 Claims, 3 Drawing Sheets

CLOTHES HANGER SPACER

This is a continuation-in-part of copending application Ser. No. 451,045 filed on Dec. 15, 1989 now abandoned.

BACKGROUND OF THE INVENTION

1. Field of the Invention

This invention relates generally to clothes hanger spacers or devices for hanging garments, and more particularly to a new and improved apparatus or device for spacing garment hangers along the length of a garment-supporting rod. Each of the apparatuses or devices for spacing garment hangers have means for attaching the device to a garment-supporting rod and also have means for suspending a garment hanger from a bottom end of the apparatus or device.

2. Description of the Prior Art

Devices for spacing garment hangers are well known in the arts. A variety of designs have been developed in the past for spacing garments along the length of a garment-supporting rod and the like. Typical examples of devices that are known to exist are illustrated in U.S. Letters Patent including U.S. Pat. No. 4,415,093 granted to Lucy J. Livingston on Nov. 15, 1983 and entitled "Garment Hanger Spacing Apparatus". This rather recent patent also describes a number of other prior art devices which are discussed in the opening paragraphs in the patent as indicating the general state-of-the-art.

All of the prior types of apparatuses or devices for spacing garment hangers are believed to be less desirable and also less efficient than the one that has been developed and which is herein disclosed. As an example, in the 093' Patent, a garment hanger spacing apparatus is disclosed that requires a multiplicity of parts and is one where the apparatus cannot be made from a one piece length of material such as a wire or a synthetic plastic rod-like member. In the 093' Patent, the device is made from a continuous strip of a resilient, flexible material such as plastic and further requires the use of a fastener 31 which is described as a clasp member and is illustrated in FIG. 2 as including first and second clasp members 131 and 132. These clasp numbers 131 and 132 (FIG. 2) serve to secure end portions 121 and 122 of the spacing apparatus 101 together. My spacing garment hanger is comprised of a single piece of material and has a closed loop for disposition beneath a clothes hanger rod with opposite ends of the single piece shaped as axially spaced hooks for hanging suspension from the clothes hanger rod and which is an improvement over the state-of-the-art.

SUMMARY OF INVENTION

The practice of the present invention, my apparatus or device for spacing garment hangers from a garment-supporting rod is manufactured from a single length of material and the ends of the single length are both utilized for attaching the apparatus or device to a garment-supporting rod. In addition, my apparatus or device includes a lower U-shaped loop which is adapted to and positioned beneath garment-supporting rod with each loop defining a large opening so that a clothes-hanger can be readily attached to the apparatus or device. The apparatus or device has axially spaced apart hook-shaped opposite end portions which are spaced apart for engagement with a garment-supporting rod at axially spaced locations along the length of the rod so as to provide a spacing effect when a plurality of my apparatuses or devices are mounted on the garment-supporting rod.

A clothes hanger spacer device for spacing garment hangers when suspended from a garment-supporting rod, comprising a one piece length of material having axially spaced apart hook-shaped opposite end portions for hooked over engagement with a garment-supporting rod, and a closed loop projecting beneath the axially spaced apart hook-shaped opposite end portions for disposition beneath a garment supporting rod for carrying a clothes hanger in hooked assembly with the closed loop.

Other features of my invention relate to the axially spaced apart hook-shaped opposite ends having identical profiles with free ends being positioned for disposition on a same side of a garment-supporting rod so as mountable and removable together from a common side of the garment-supporting rod.

Still other features of my invention relate to the device having its closed loop having a U-shape and with the clothes hangers being retaining engageable within the U in hooked assembly therewith and with the U being closed beneath the garment-supporting rod when in assembly to resist accidental disassembly of the clothes hanger therefrom.

A modified embodiment of my present invention relates to the axially spaced apart hook-shaped opposite ends having reversed profiles with free ends being disposed on opposite sides of a garment-supporting rod.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENTS

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
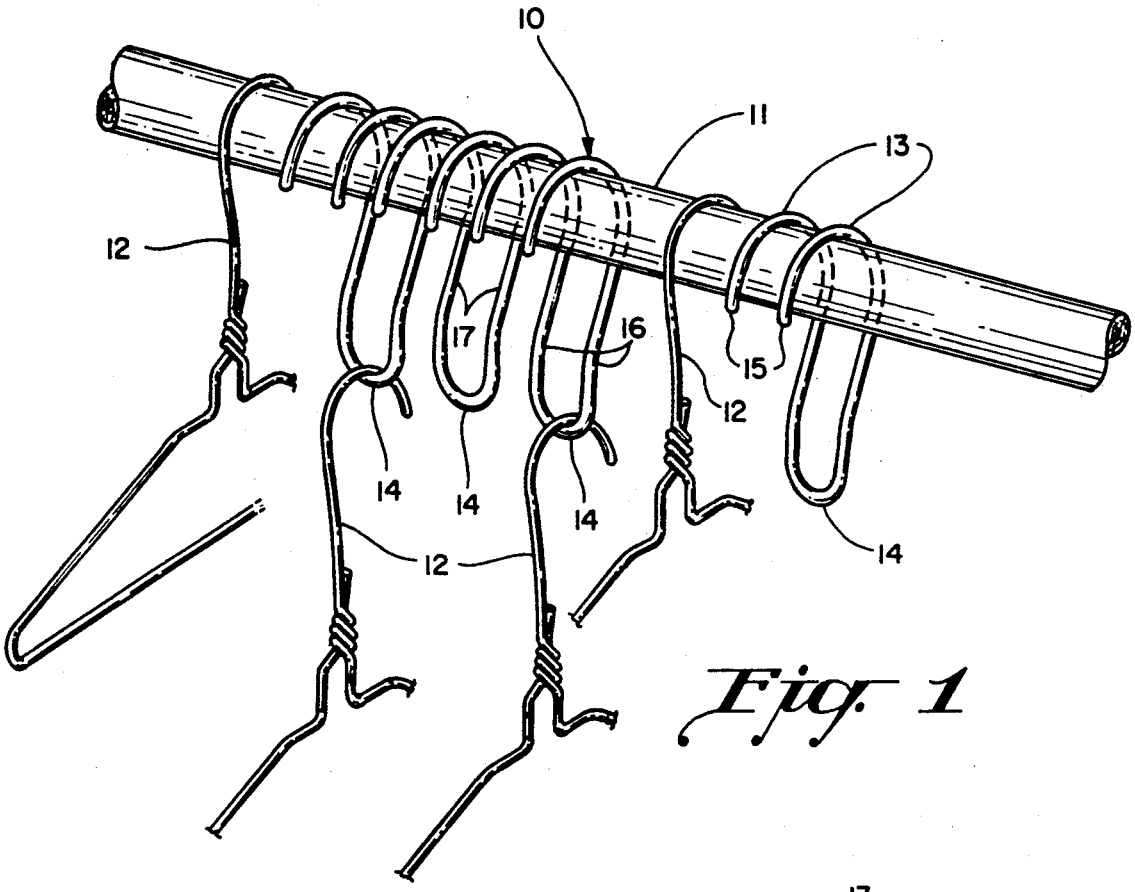
FIG. 1 is an enlarged fragmentary perspective view of a garment hanger spacing apparatus embodying important features of my invention and attached to a garment-supporting rod with garment hangers suspended therefrom.

Referring to the drawings in more detail, the reference numeral 10 indicates my clothes hanger spacer apparatus or device for spacing garment hangers. Such hangers 10 are adapted to be mounted upon a garment-supporting rod 11. Clothes hangers 12 are adapted to be mounted on the apparatus or device 10 as well as on the garment-supporting rod 11 all as shown in FIG. 1.

The clothes hanger spacer can be manufactured from a variety of different materials. One embodiment would be aluminum wire with a diameter between 0.125 inches and 0.300 inches. The hook shaped portions 13 formed with a radius of ¾" to 1½". The hooked shaped portions 13—13 are axially spaced apart within the range of 1 to 3 inches, to provide an axial space between clothes hangers 12.

Other embodiments could use (but would not be limited to) cold rolled steel wire with a diameter in the range of 0.060 inch to 0.250 inch, or a filled or unfilled thermoplastic with dimensions similar to the aluminum embodiment identified above.

The device 10 includes a U-shaped loop 14 that when mounted upon the rod 11 is adapted to the suspended beneath the rod for receipt of a hooked upper end of the clothes hanger 12. According to features of my invention, by providing a relatively large U-shaped loop at an underneath or lower end of device 10, the hangers 12 can be more easily attached to the device 10 and removed from the device 10 as may be required.

When the hangers are mounted in a closet in side-by-side relation coat hangers can be hung from the bottom of the U at the bottom of each clothes hanger spacer. This prevents clothing so hung from being pressed together and wrinkled. Also, coat hangers can be located between the spacers in which event the spacers can be at least partially spaced from one another.

Figure 2:
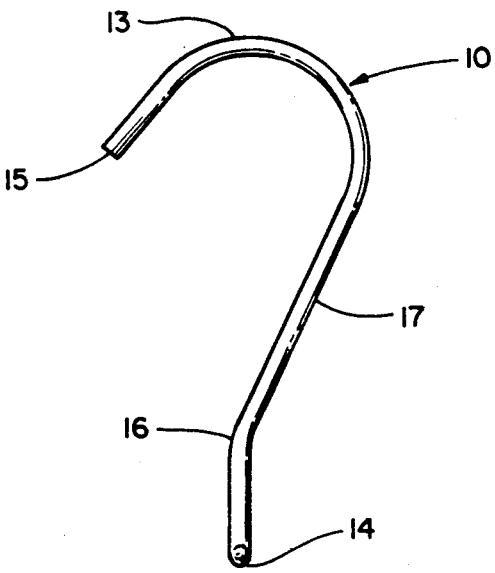
FIG. 2 is a side elevation of an apparatus or device for spacing garment hangers on a garment-supporting rod.
Figure 3:
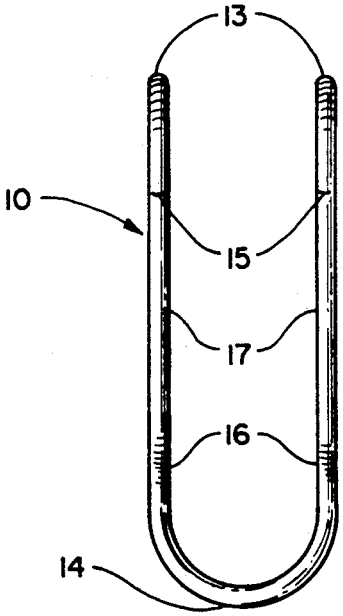
FIG. 3 is a front elevation of the apparatus or device shown in FIG. 2.

It will further be seen from a consideration of FIGS. 1-3, that my apparatus or device 10 has a pair of free ends 15—15 carried on the axially spaced apart hook-shaped opposite end portions 13—13. These free ends are adapted to provide part of the attachment means for securing the apparatus or device 10 to the rod 11. By locating the free ends 15—15 on an upper end of the device 10, it is possible to not only manufacture the device 10 from a single piece of material but also to provide a relatively large closed U-shaped loop at an underneath position beneath the garment-supporting rod 11 so that the clothes hangers 12 can be readily attached thereto.

The apparatus or device 10 includes axially spaced apart hook-shaped opposite ends portions 13—13. The spaced apart portions 13—13 enable the device 10 to be securely mounted on the garment-supporting rod 11. The spacing between the spaced apart portions 13—13 may be of the order of one half inch (½") to one inch (1") as the suitable spacing arrangement. It will be noted that in the embodiment of my invention, that the opposite end portion 13—13 terminate both on the same side of the garment-supporting rod as shown in FIG. 1.

In order to allow the hook-shaped opposite end portions 13—13 to engage around the garment-supporting rod and yet to locate the U-shaped loop directly beneath a vertical axis through the center of the garment-supporting rod, I have found that excellent results can be attained by providing bent rod portions 16—16 at the junctures of opposite end portions of the U-shaped closed loop with the inclined portions 17—17. This construction permits the apparatus or device 10 to be properly centered and balanced on the garment-supporting rod 11 when mounted thereon. It will further be seen from a viewing of FIG. 1 that by axially spreading the hooked-shaped opposite end portions 13—13 apart, that clothing hung on the clothes hanger 12 from the under located U-shaped closed loop will enable the clothes hangers positioned on adjacent devices 10—10 located at opposite sides to be spaced apart so that the clothes hung on the hangers 12 can be hung and maintained in a more separated relationship with respect to other garments. By hanging the clothing garments apart, the garments can be hung in such a way that they will not become wrinkled as readily and further so that air can flow between the garments to maintain the garments in a fresher condition when in storage.

Figure 4:
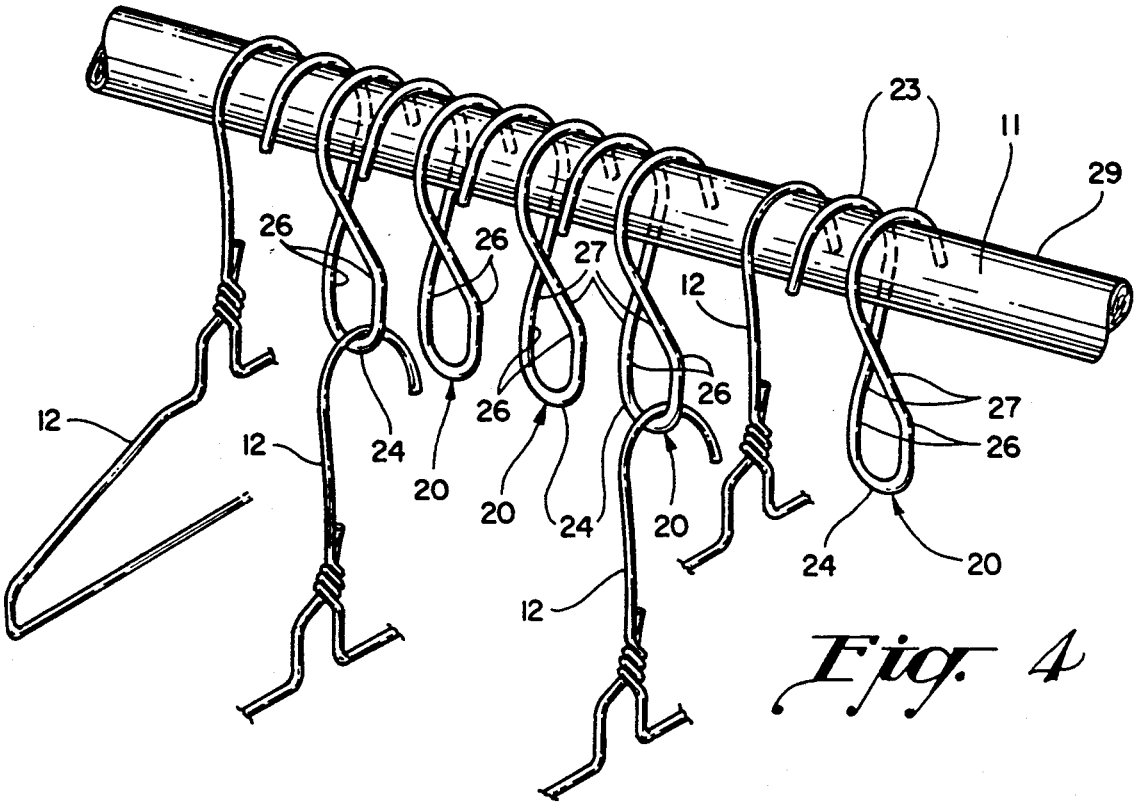
FIG. 4 is an enlarged fragmentary perspective view similar to FIG. 1 only illustrating a modified type of an apparatus or device for spacing garment hangers from a garment-supporting rod.
Figure 5:
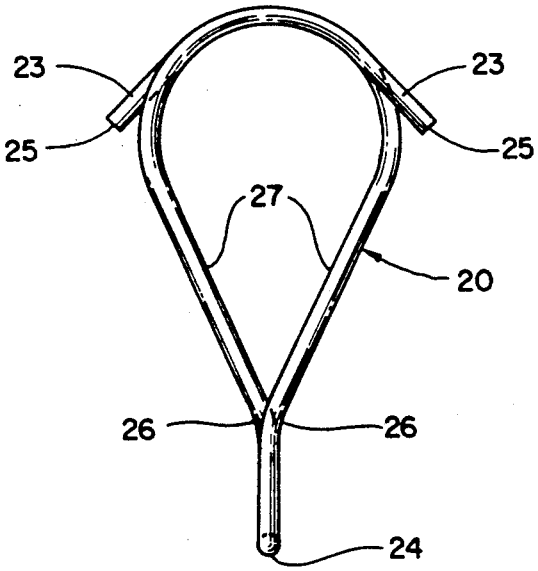
FIG. 5 is a side view of a modified type of apparatus or device for spacing garment hangers as also seen in FIG. 4.
Figure 6:
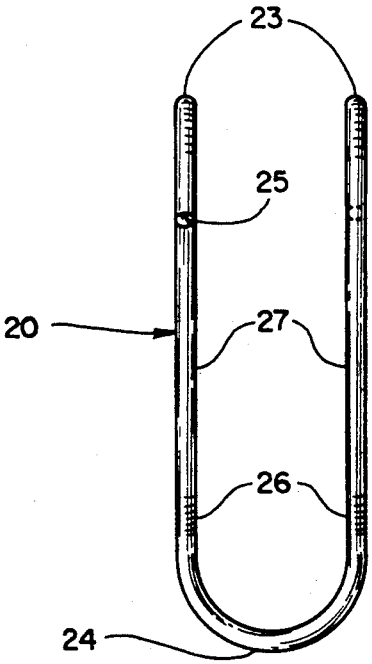
FIG. 6 is a front elevation of an apparatus or device for spacing garment hangers also as illustrated and described in FIGS. 4 and 5.

Shown in FIG. 4-6 is a modified form of my invention wherein a modified clothes hanger spacer apparatus or device for spacing garment hangers 20 is illustrated. This device can be manufactured from the same materials as previously described and can be used in much the same way except for the manner of assembly and disassembly of the device 10 with the rod 11. Here again, clothes hangers 12 are adapted to be suspended from the apparatus or device 20 all as shown in FIG. 4.

In this form of my invention, the apparatus or device for spacing garment hangers 20 includes axially spaced apart hook-shaped opposite end portions 23—23. The device 20 further includes a U-shaped loop 24, free ends 25—25, bent rod portions 26—26, and inclined rod portions 27—27.

In this embodiment of my invention, the bent rod portions are not angled in the same direction but in opposite directions so that the hook-shaped opposite end portions 23—23 terminate on opposite sides of the hanger rod 11 when mounted thereon.

In order to assemble the apparatus or device 20 upon a hanger rod 11, the operator must take advantage of the axial gap indicated generally at 28 that exists between the hook-shaped end portions 23—23. To this end, when the device 20 is to be mounted on the hanger rod 11 the device 20 must be positioned at right angles to the position shown in FIG. 4 whereupon the hook-shaped opposite end portions 23—23 are pushed upwardly with the hanger rod 11 being lodged in the gap 28 until free ends 25—25 are positioned above a top edge 29 of the garment-supporting rod whereupon the device 20 is rotated 90 degrees so that the hook-shaped opposite end portions 23—23 can engage the hanger rod 11 as shown in FIG. 4.

In order to effect disassembly of the device 20 from the hanger rod 11, the assembly steps must be reversed. To this end, the U-shaped loop 24 must be pushed upwardly so that free ends 25—25 are moved to a position slightly above the top edge 29 of the hanger rod 11 whereupon the person removing the device 20 can rotate the device 20 90 degrees so that the gap 28 between the hook-shaped opposite end portions 23—23 can be caused to be aligned when the device 20 is in a sidewise position (not shown) whereupon the person can manually pull the device 20 downwardly with the side faces of the hook-shaped opposite end portions 23—23 passing on opposite sides of the rod hanger 11 thereby freeing the device 20 from the rod hanger 11.

The portions 27—27 are inclined in crossing x-shaped relation from the lower end junctures with opposite end portions of the loop 24 to junctures with the hook-shaped opposite end portions 23—23. The bent rod portions 26—26 are at the lower end junctures as stated in the previous sentence.

The closed loop 14 lies in a vertical plane that intersects a longitudinal axis of the common-supporting rod 11 when the spacer device 10 is mounted thereon as seen in FIG. 1. In FIG. 4, the hanger spacer device 20 has its closed loop 24 disposed in a vertical plane that also intersects a longitudinal axis of the common-supporting rod 11 when the spacer device 20 is mounted thereon as generally shown in FIG. 4.

Figure 7:
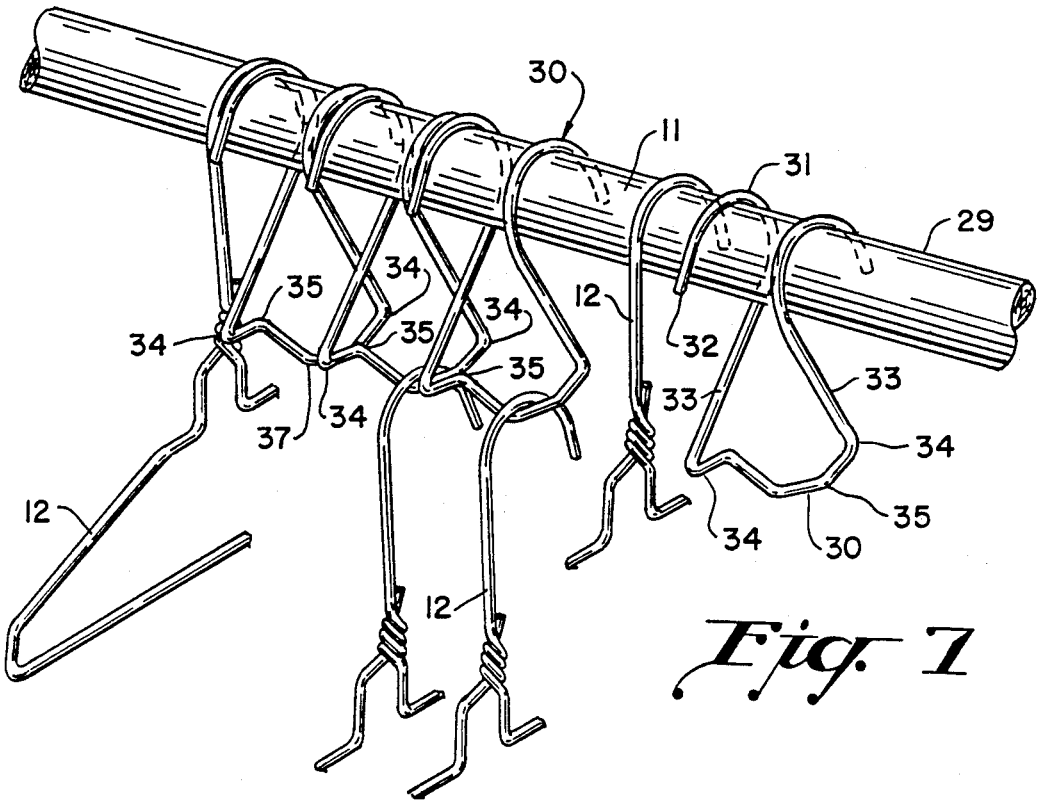
FIG. 7 is an enlarged fragmentary perspective view illustrating a modified type of the apparatus or device for spacing garment hangers from a garment-supporting rod.
Figure 8:
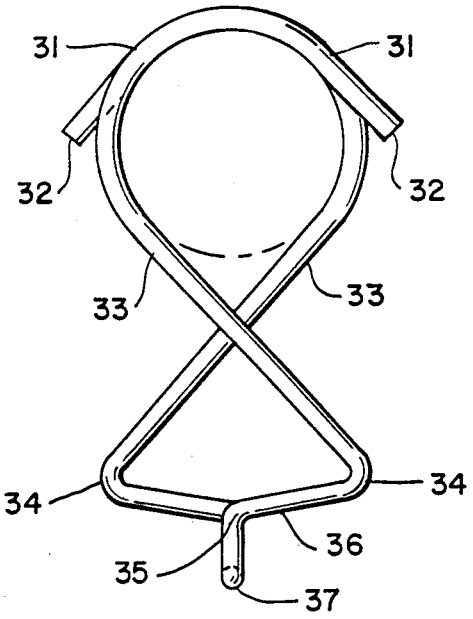
FIG. 8 is a side view of a modified type of apparatus or device for spacing garments hangers as also seen in FIG. 7.
Figure 9:
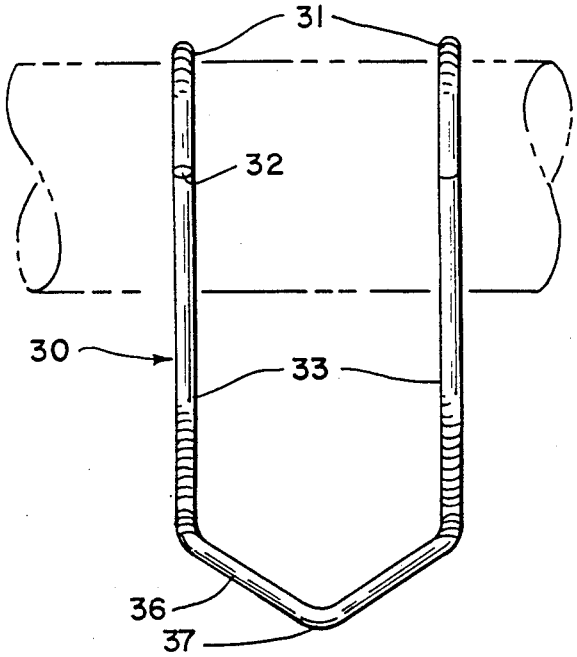
FIG. 9 is a front elevation of an apparatus or device for spacing garment hangers also as illustrated and described in FIGS. 7 and 8.

In all forms of my invention, the close hanger spacer devices 20 and 20 are resiliently deflectible or springable so that portion 17—17 in FIG. 3 can be moved together and yet after being moved more closely together and released, the portion 17—17 can spring apart and return to their original position. In FIG. 6, the portions 27—27 also can be moved in a similar manner and this feature is useful particularly where the spacer 20 is being pressed into assembly with the rod 11 so that portions 27—27 can spread apart and move past the rod 11 in assembly and disassembly of the spacer device 20 therewith. Shown in FIGS. 7-9 is another modified form of my invention wherein a modified clothes hanger spacer apparatus or device for spacing garment hangers is illustrated. Materials of manufacture are the same as previously described.

In this form of my invention, the apparatus or device for spacing garment hangers 30 includes axially spaced apart hook-shaped opposite end portions 31—31, free ends 32—32 and inclined rod portions 33—33. The inclined rod portions 33—33 are angled in opposite directions so that the hook-shaped opposite end portions 31—31 terminate on opposite sides of the hanger rod 11 when mounted thereon. Inclined rod portions 33—33 are inclined in a crossing x-shaped relation from the hook-shaped opposite end portion 31 to an outside bent rod juncture 34 permitting the outside bent rod juncture 34 to extend to a point beneath each opposite end portion 31—31 by crossing beneath the hanger rod 11 when mounted thereon to a position beneath free end 32 on the same side, continuing in a angular bend direction to bent rod juncture 35 situated near or at a centerline point beneath the x-crossing as viewed from the side and then inwardly to angular V-shaped portion 36.

The V-shaped portion 36 is a modification of the aforementioned U-shaped loop as depicted by numeral 14 in FIG. 3 and number 24 in FIG. 6. The relatively large V-shaped portion 36 lies in a vertical plane that intersects a longitudinal axis of the common-supporting rod 11 when the spacer device 30 is mounted on the supporting rod. The lowest portion of the V-shaped portion 36 angles downwardly to lower bent rod juncture 37. When the device is mounted upon the rod 11 the V-shaped portion 36 is suspended beneath the rod for receipt of a hooked upper end of the clothes hanger 12. Either side of the lower bent rod juncture 37 forms an identical profile in reverse.

In order to assemble the apparatus or device 30 upon a hanger rod 11 it should be noted that the procedure is similar to that described and shown in the FIGS 4-6. The operator, in this modified form of the invention, must take advantage of the axial gap that exists between the hook-shaped opposite end portions 31—31. To this end, when the device 30 is to be mounted on the hanger rod 11 the device 30 must be positioned at right angles to the position shown in FIG. 7 whereupon the hook-shaped opposite end portions 31—31 are pushed upwardly with the hanger rod 11 being lodged in the opening between the axially spaced apart hook-shaped opposite end portions whereby free ends 32—32 are positioned above a top edge 29 of the garment-supporting rod whereupon the device 30 is rotated 90 degrees so that the hook-shaped opposite end portions 31—31 can engage the hanger rod 11 as shown in FIG. 7.

In order to effect disassembly of the device 30 from the hanger rod 11, the assembly steps must be reversed. To this end, the V-shaped section 36 must be pushed upwardly so that free ends 32—32 are moved to a position slightly above the top edge 29 of the hanger rod 11 whereupon the person removing the device 30 can rotate the device 90 degrees so that the axially gap between the hook-shaped opposite end portions 31—31 can be caused to be aligned when the device 30 is in a sideways position (not shown) whereupon the person can manually pull the device 30 downwardly with the side faces of the hook-shaped opposite end portions 31—31 passing on opposite sides of the hanger rod 11 thereby freeing the device 30 from the hanger rod 11.

Referring back to FIG. 7, when a plurality of devices 30 are placed side by side on hanger rod 11, the side surfaces of the opposite end portion 31, free end 32, inclined rod portion 33, outside bent rod juncture 34, and bent rod juncture 35 form a z-shape cross sectional contact area which when placed against a second device provides a secure means for separation at the top, middle and bottom contact points between other devices. The addition of the outside bent rod junctures 34—34 provide a larger cross sectional surface area to prevent the lower portions of the device from overlapping similar devices when mounted upon the hanger rod 11.

In FIG. 9, the spaced apart opposite end portions 31—31 also can be moved in a similar manner and this feature is useful particularly where the spacer 30 is being pressed into assembly with the rod 11 so that spaced apart opposite end portions 31—31 can spread apart and move past the rod 11 in assembly and disassembly of the spacer device 30 therewith. The V-shaped section on this modified form of my device can be replaced by the U-shaped section of the previously mentioned forms of my device.

It is to be understood that while I have illustrated and described certain forms of my invention, it is not to be limited to the specific forms or arrangement of parts herein described and shown.

I claim:

1. A clothes hanger spacer device for spacing garment hangers when suspended from a garment-supporting rod, comprising a one piece length of material having axially spaced apart hook-shaped opposite end portions having a radius between (¾") to (1½") for hooked over engagement with a garment-supporting rod;

bent rod junctures positioned in the same plane and projecting beneath said axially spaced apart hook-shaped opposite end portions; and a U-shaped closed loop beneath said bent rod junctures for disposition beneath a garment-supporting rod for carrying a clothes hanger in hooked assembly with the U-shaped closed loop, said axially spaced apart hook-shaped opposite end portions having identical profiles for disposition on the same side of a garment-supporting rod when assembled thereon.

2. The device of claim 1 further defined by said axially spaced apart hook-shaped opposite ends having identical profiles with free ends being positioned for disposition on a side of a garment-supporting rod so as to be attachable and removable from a common side of a garment-supporting rod when assembled therewith.

3. The device of claim 1 further defined by said axially spaced apart hook-shaped opposite ends having reversed profiles with free ends being positioned for disposition on opposite sides of a garment-supporting rod when assembled thereon.

4. The device of claim 1 further characterized by the closed loop being U-shaped and with the clothes hanger being retaining engageable within the U in hooked assembly therewith and with the U being closed beneath the garment-supporting rod when in assembly to resist accidental assembly of the clothes hanger therefrom.

5. The device of claim 1 further defined by said one piece length of material being yieldable and springy enabling the opposite ends to move apart to pass over a garment-supporting rod and to return to an original position thereafter, said axially spaced apart hook-shaped opposite ends having reversed profiles with free ends being positioned for disposition on opposite sides of a garment-supporting rod when assembled thereon.

6. The device of claim 1 further defined by said axially spaced apart hook-shaped opposite ends having identical profiles with free ends being positioned for disposition on a side of a garment-supporting rod so as to be attachable and removable from a common side of a garment-supporting rod when assembled therewith, the closed loop being U-shaped and with the clothes hanger being retaining engageable within the U in hooked assembly therewith and with the U being closed beneath the garment-supporting rod when in assembly to resist accidental assembly of the clothes hanger therefrom.

7. The device of claim 1 further defined by said axially spaced apart hook-shaped opposite ends having reversed profiles with free ends being positioned for disposition on opposite sides of garment-supporting rod when assembled thereon, the hook-shaped opposite ends being joined to opposite end portions of the closed loop by oppositely inclined hanger positioned in an x-shaped configuration when the hanger is viewed from its side.

8. The device of claim 1 further characterized by the U-shaped being a V-shaped section and with the clothes hanger being retaining engageable with said V-shaped section in hooked assembly therewith and with said V-shaped section being closed beneath the garment-supporting rod when in assemble to resist accidental assembly of the clothes hanger therefrom.

9. A clothes hanger spacer device for spacing hangers when suspended from a garment-supporting rod, comprising a one piece length of material having axially spaced apart hook-shaped opposite end portions for hooked over engagement with a garment-supporting rod, and a closed loop projecting beneath said axially spaced apart hook-shaped opposite end portions for disposition beneath a garment-supporting rod for carrying a clothes hanger in hooked assembly with the closed loop said axially spaced apart hook-shaped opposite ends having identical profiles with free ends being positioned for disposition on a side of a garment-supporting rod so as to be attachable and removable from a common side of a garment-supporting rod when assembled therewith, said loop lying in a vertical plane that intersects a longitudinal axis of the garment-supporting rod when the spacer device is mounted thereon.

10. A clothes hanger spacer device for spacing garment hangers when suspended from a garment-supporting rod, comprising a one piece length of material having axially spaced apart hook-shaped opposite end portions having a radius between ($\frac{3}{4}''$) to ($1\frac{1}{2}''$) for hooked over engagement with a garment-supporting rod;

bent rod junctures positioned in the same plane and projecting beneath said axially spaced apart hook-shaped opposite end portions; and a U-shaped closed loop beneath said bent rod junctures for disposition beneath a garment-supporting rod for carrying a clothes hanger in hooked assembly with the U-shaped closed loop, axially spaced apart hook-shaped opposite end portions having reversed profiles with free ends being positioned for disposition on opposite sides of a garment-supporting rod when assembled thereon, the hook-shaped opposite ends being joined to opposite end portions of the U-shaped closed loop by oppositely inclined hanger portions in an x-shaped configuration when the hanger is viewed from its side, said U-shaped closed loop lying in a vertical plane that intersects a longitudinal axis of the garment-supporting rod when the spacer device is mounted thereon.

11. The device of claim 10 further characterized by the U-shaped being a V-shaped section and with the clothes hanger being retaining engageable with said V-shaped section in hooked assembly therewith and with said V-shaped section being closed beneath the garment-supporting rod when in assemble to resist accidental assembly of the clothes hanger therefrom.

12. The device of claim 10 wherein the x-shaped configuration is further defined by an outside bent rod juncture positioned beneath the free end for disposition on the same side of a garment-supporting rod when assembled thereon.

13. A clothes hanger spacer device for spacing garment when suspended from a garment-supporting rod comprising:

a one piece length of material with free ends having axially spaced apart hook-shaped opposite end portions of identical profile for hooked over engagement with a garment-supporting rod;

an outside bent rod juncture positioned in the same plane beneath each free end;

a bent rod juncture positioned in the same plane as the outside bent rod juncture beneath said axially space apart hook-shaped opposite end portions; and a V-shaped section projecting beneath said axially spaced apart hook-shaped opposite end portions for disposition beneath a garment-supporting rod for carrying a clothes hanger in hooked assembly with the V-shaped section, axially spaced apart hook-shaped opposite ends having reversed profiles with free ends having reversed profiles, said free ends being positioned for disposition on opposite sides of a garment-supporting rod when assembled thereon, said hook-shaped opposite ends being joined to opposite end portions by oppositely inclined hanger portions in an x-shaped configuration when the hanger is viewed from its side by extending to said outside bent rod juncture positioned beneath said free end for disposition on the same side of a garment-supporting rod when assembled thereon and angular bend to said bent rod juncture beneath said axially spaced apart hook shaped opposite end portions to said V-shaped section lying in a vertical plane that intersects a longitudinal axis of the garment-supporting rod when the spacer device is mounted thereon.

* * * * *